US010041754B2

(12) United States Patent
Tamir

(10) Patent No.: US 10,041,754 B2
(45) Date of Patent: Aug. 7, 2018

(54) QUICK-OPENING SLIDE-ABLE SHELL EJECTION PORT COVER

(71) Applicant: ISRAEL WEAPON INDUSTRIES (I.W.I) LTD., Ramat HaSharon (IL)

(72) Inventor: Ran Tamir, Rehovot (IL)

(73) Assignee: ISRAEL WEAPON INDUSTRIES (I.W.I.) LTD., Ramat Hasharon (IL)

( * ) Notice: Subject to any disclaimer, the term of this patent is extended or adjusted under 35 U.S.C. 154(b) by 0 days.

(21) Appl. No.: 15/600,742

(22) Filed: May 21, 2017

(65) Prior Publication Data

US 2017/0343312 A1 Nov. 30, 2017

(30) Foreign Application Priority Data

May 24, 2016 (IL) ..... 245833

(51) Int. Cl.
*F41A 35/02* (2006.01)
*F41A 35/06* (2006.01)

(52) U.S. Cl.
CPC ..... *F41A 35/02* (2013.01); *F41A 35/06* (2013.01)

(58) Field of Classification Search
USPC ..... 42/96, 98
See application file for complete search history.

(56) References Cited

U.S. PATENT DOCUMENTS 1,878,038 A 9/1932 Frommer
2,341,767 A 2/1944 Gans
2,933,842 A * 4/1960 Reed ..... F41A 17/38 42/18
3,368,298 A 2/1968 Browning
3,881,268 A * 5/1975 Petersen ..... F41A 9/60 42/98
3,984,932 A * 10/1976 Morton ..... F41A 9/60 42/98
3,999,318 A * 12/1976 Tellie ..... F41A 35/02 42/106
4,044,487 A 8/1977 Hutton et al.
7,819,052 B2 10/2010 Zedrosser
8,393,103 B2 3/2013 Brown
8,448,363 B2 5/2013 Fargnoil et al.
9,341,429 B1 * 5/2016 Reavis, III ..... F41A 35/02
9,395,131 B1 * 7/2016 Clark ..... F41A 15/10
(Continued)

*Primary Examiner* — Bret Hayes
(74) *Attorney, Agent, or Firm* — Soroker Agmon Nordman

(57) ABSTRACT

A slideable ejection port cover having at least two configurations, an open configuration in which shell ejection via the ejection port is enabled, and a closed configuration in which the ejection port is substantially immovably covered; the ejection port cover comprising a shutter operatively connected to a locking component, the shutter slideable along a longitudinal axis of the receiver; wherein the locking component comprises a spring configured, at such times as the ejection port cover is in the closed configuration, to hold the locking component in a pressure-applying mode against the receiver, the pressure-applying mode being a default mode, thereby immobilizing the shutter relative to the receiver, and the locking component configured to compress the spring when pulled manually away from the receiver, thereby enabling reversible transformation of the ejection port cover from the closed configuration to the open configuration.

20 Claims, 10 Drawing Sheets

(56) References Cited

U.S. PATENT DOCUMENTS

| | | | | |
|---|---|---|---|---|
| 9,612,075 | B1 * | 4/2017 | Stephens, IV | F41A 35/02 |
| 2003/0230020 | A1 * | 12/2003 | Christiansen | F41A 17/44 42/1.05 |
| 2012/0174451 | A1 * | 7/2012 | Overstreet | F41A 3/12 42/16 |
| 2015/0285579 | A1 * | 10/2015 | Hawley | F41A 35/02 42/96 |

* cited by examiner

QUICK-OPENING SLIDE-ABLE SHELL EJECTION PORT COVER

FIELD OF THE INVENTION

The present invention generally relates to firearms, and more specifically for mechanisms allowing shell ejection from the right or left of a firearm.

BACKGROUND OF THE INVENTION

Firearms can be designed to incorporate a shell ejection port on both sides of the rifle, right or left. This enables the end-user to choose which side the shell would eject according to the end-user's right or left shooting habits. The ejection port on the desired ejection direction should be left opened, while the other, passive, ejection port should be covered in order to prevent dust and debris from entering the rifle through the port.

However, ejection port covers available today are cumbersome to assemble and dismantle and require the work of a professional, thus taking massive time and effort.

Therefore, there is a long felt need for a quick opening slide-able shell ejection port cover, as provided by the present invention.

SUMMARY OF THE INVENTION

It is one object of the present invention to provide a slideable ejection port cover for right-side or left-side shell ejection, for use in a rifle's receiver, the receiver characterized by an ejection port; the slideable ejection port cover characterized by having at least two configurations, an open configuration in which, at such times as the slideable ejection port cover is in use in the receiver, shell ejection via the ejection port is enabled, and a closed configuration in which, at such times as the slideable ejection port cover is in use in the receiver, the ejection port is substantially immovably covered; the ejection port cover comprising a shutter operatively connected to a locking component, the shutter slideable along a longitudinal axis of the receiver; wherein the locking component comprises a spring configured, at such times as the slideable ejection port cover is used in the rifle's receiver and the ejection port cover is in the closed configuration, to hold the locking component in a pressure-applying mode against the receiver, the pressure-applying mode being a default mode, thereby immobilizing the shutter relative to the receiver, and the locking component configured to compress the spring when pulled manually away from the receiver, thereby enabling reversible transformation of the ejection port cover from the closed configuration to the open configuration.

It is another object of the present invention to provide, in a rifle's receiver a slideable ejection port cover for right-side or left-side shell ejection; characterized by having at least two configurations, an open configuration in which a shell ejection is enabled and a closed configuration in which the ejection port is substantially immovably covered; the ejection port cover comprising a shutter operatively connected to a locking component, the shutter slideable along a longitudinal axis of the receiver; wherein the locking component comprises a spring, configured to hold the locking component in a default pressure-applying mode against the receiver, thereby immobilizing the shutter relative to the receiver, and the locking component configured to compress the spring when pulled manually away from the receiver, thereby enabling reversible transformation of the ejection port cover from the closed configuration to the open configuration.

It is still an object of the present invention to provide the ejection port cover as mentioned above, wherein the receiver comprises at least two ejection ports positioned on opposite sides thereof, each of which is adapted to accommodate the ejection port cover.

It is still an object of the present invention to provide the ejection port cover as mentioned above, wherein the ejection port cover additionally comprises at least one securing screw configured to enable rotation of the locking component with respect to the port cover in an angle between about 180° and about 360°.

It is still an object of the present invention to provide the ejection port cover as mentioned above, wherein the ejection port cover additionally comprises at least two securing screws, at least one first securing screw and at least one second securing screw configured to be in a mechanical connection of a male-female locking mechanism.

It is still an object of the present invention to provide the ejection port cover as mentioned above, wherein, in the open configuration, the locking component is substantially immovable relative to the receiver.

It is still an object of the present invention to provide the ejection port cover as mentioned above, wherein, in the open configuration, the default pressure-applying mode of the spring is configured to hold the locking component against the receiver, thereby substantially immobilizing the locking component and the shutter relative to the receiver.

It is still an object of the present invention to provide the ejection port cover as mentioned above, wherein, in the open configuration, at such times as the slideable ejection port cover is in use in the receiver, the locking component is adapted to function as a spent case deflector.

It is still an object of the present invention to provide the ejection port cover as mentioned above, wherein the locking component comprises a first at least a portion of a mechanical connector, the first at least a portion of the mechanical connector characterized by a member of a group consisting of: a groove, a rib and any combination thereof on the locking component, for reversibly locking the locking component in place.

It is still an object of the present invention to provide the ejection port cover as mentioned above, wherein the receiver comprises a second at least a portion of the mechanical connector, the second at least a portion of the mechanical connector characterized by a member of a group consisting of: a groove, a rib and any combination thereof on the receiver, the second at least a portion of the mechanical connector configured to coordinate with the first at least a portion of the mechanical connector.

It is still an object of the present invention to provide the ejection port cover as mentioned above, wherein the shutter further comprises a third at least a portion of the mechanical connector, the third at least a portion of the mechanical connector characterized by a member of a group consisting of: a groove, a rib and any combination thereof on the shutter, the third at least a portion of the mechanical connector configured to coordinate with the first at least a portion of the mechanical connector.

It is still an object of the present invention to provide the ejection port cover as mentioned above, wherein the shutter further comprises at least one of a group consisting of a furrow, a ridge and any combination thereof adapted for guiding the shutter along a longitudinal axis of the receiver.

It is still an object of the present invention to provide the ejection port cover as mentioned above, wherein the at least one of a group consisting of a furrow, a ridge and any combination thereof is located along at least part of a contour of the shutter.

It is still an object of the present invention to provide the ejection port cover as mentioned above, wherein at least one ridge coordinates with at least one furrow, the ridge located on an opposite side of the shutter from the furrow.

It is still an object of the present invention to provide the ejection port cover as mentioned above, wherein the ejection port cover further comprises a flange adapted to slide in a groove in the receiver, the ejection port reversibly coverable by means of the sliding movement.

It is still an object of the present invention to provide the ejection port cover as mentioned above, wherein manually pulling the locking component disengages the locking component from the receiver, enabling transformation of the ejection port cover from the closed configuration to the open configuration.

It is still an object of the present invention to provide the ejection port cover as mentioned above, wherein manually pulling the locking component disengages the locking component from the shutter, enabling transformation of the ejection port cover from the open configuration to the closed configuration.

It is still an object of the present invention to provide the ejection port cover as mentioned above, wherein rotation of the locking component about an axis substantially perpendicular to the shutter by about 180° reversibly transforms the ejection port cover from the closed configuration to the open configuration.

It is yet another object of the present invention to provide a method for either right-side or left-side shell ejection, comprising steps of: (a) obtaining a slideable ejection port cover for use in a rifle's receiver, the receiver characterized by an ejection port; the slideable ejection port cover characterized by having at least two configurations, an open configuration in which, at such times as the slideable ejection port cover is in use in the receiver, shell ejection via the ejection port is enabled and a closed configuration in which, at such times as the slideable ejection port cover is in use in the receiver, the ejection port is substantially immovably covered; the ejection port cover comprising a shutter operatively connected to a locking component, the shutter slideable along a longitudinal axis of the receiver; (b) mounting the ejection port cover to the rifle's receiver; and (c) reversibly sliding the shutter along a longitudinal axis of the receiver; wherein the method further comprises steps of (a) configuring a spring to hold the locking component, at such times as the ejection port cover is in the closed configuration, in a default pressure-applying mode against the receiver, thereby immobilizing the shutter relative to the receiver, and (b) configuring the locking component such that manually pulling the locking component away from the receiver compresses the spring, thereby enabling reversible transformation of the ejection port cover from the closed configuration to the open configuration.

It is still an object of the present invention to provide the method as mentioned above, further comprising step of configuring at least one securing screw to enable rotation of the locking component with respect to the port cover in an angle between about 180° and about 360°.

It is still an object of the present invention to provide the method as mentioned above, further comprising steps of providing at least two securing screws and configuring at least one first securing screw and at least one second securing screw to be in a mechanical connection of a male-female locking mechanism.

It is still an object of the present invention to provide the method as mentioned above, further comprising step of, in the open configuration, substantially immobilizing the locking component and the shutter relative to the receiver.

It is still an object of the present invention to provide the method as mentioned above, further comprising step of, in the open configuration, configuring the default pressure-applying mode of the spring to hold the locking component against the receiver, thereby substantially immobilizing the locking component and the shutter relative to the receiver.

It is still an object of the present invention to provide the method as mentioned above, further comprising steps of adapting the locking component to function as a spent case deflector at such times as the slideable ejection port cover is in use in the receiver and the slideable ejection port cover is in the open configuration.

It is still an object of the present invention to provide the method as mentioned above, further comprising steps of providing the ejection port cover comprising a first at least a portion of a mechanical connector, the first at least a portion of the mechanical connector characterized by a member of a group consisting of: a groove, a rib and any combination thereof on the locking component; and of reversibly locking the locking component in place by means of the mechanical connector.

It is still an object of the present invention to provide the method as mentioned above, further comprising steps of providing the receiver comprising a second at least a portion of the mechanical connector, the second at least a portion of the mechanical connector characterized by a member of a group consisting of: a groove, a rib and any combination thereof on the receiver; and reversibly securing the locking component to the receiver by means of coordination between the first at least a portion of the mechanical connector and the second at least a portion of the mechanical connector.

It is still an object of the present invention to provide the method as mentioned above, further comprising steps of providing the shutter comprising a third at least a portion of the mechanical connector, the third at least a portion of the mechanical connector characterized by a member of a group consisting of: a groove, a rib and any combination thereof on the shutter; and reversibly securing the locking component to the shutter by means of coordination between the first at least a portion of the mechanical connector and the third at least a portion of the mechanical connector.

It is still an object of the present invention to provide the method as mentioned above, further comprising steps of providing the port cover further comprising a shutter characterized by at least one of a group consisting of: a furrow, a ridge and any combination thereof, and guiding the shutter along a longitudinal axis of the receiver.

It is still an object of the present invention to provide the method as mentioned above, further comprising step of locating the at least one of a group consisting of a furrow, a ridge and any combination thereof along at least part of the contour of the shutter.

It is still an object of the present invention to provide the method as mentioned above, further comprising step of configuring the shutter such that the at least one ridge coordinates with at least one the furrow, the ridge located on an opposite side of the shutter from the furrow.

It is still an object of the present invention to provide the method as mentioned above, further comprising steps of sliding a flange of the ejection port cover in a groove in the receiver, and of reversibly covering the ejection port by sliding the port cover along the groove.

It is still an object of the present invention to provide the method as mentioned above, further comprising steps of disengaging the locking component from the receiver by manually pulling the locking component, and of transforming the ejection port cover from the closed configuration to the open configuration.

It is still an object of the present invention to provide the method as mentioned above, further comprising steps of disengaging the locking component from the receiver by manually pulling the locking component, and of transforming the ejection port cover from the open configuration to the closed configuration.

It is lastly an object of the present invention to provide the method as mentioned above, further comprising steps of rotating of the locking component about an axis substantially perpendicular to the shutter by about 180°, thereby reversibly transforming the ejection port cover from the closed configuration to the open configuration.

BRIEF DESCRIPTION OF THE DRAWINGS

In order to understand the invention and to see how it may be implemented in practice, several embodiments will now be described, by way of non-limiting example only, with reference to the accompanying drawing, in which.

DETAILED DESCRIPTION OF THE PREFERRED EMBODIMENTS

The following description is provided, alongside all chapters of the present invention, so as to enable any person skilled in the art to make use of the invention and sets forth the best modes contemplated by the inventors of carrying out this invention. Various modifications, however, are adapted to remain apparent to those skilled in the art, since the generic principles of the present invention have been defined specifically to provide a slideable ejection port cover for either a right-side or left-side shell ejection, for use in a rifle's receiver.

The term "receiver" refers to the part of a rifle or revolver or other firearm that holds the mechanical parts of the firearm, which include, but are not limited to, the trigger mechanism, bolt carrier and feed assembly.

The position terms used in the present disclosure, such as "front", "forward", "rear", backward, "back", "top", "bottom", "left", "right", "head", "tail", "first side", "second side", "sides" or the like assume a firearm in the normal firing position, with the firearm being in a position in which the longitudinal axis of the barrel of the firearm runs generally horizontally and the direction of firing points "forward" away from the operator of the firearm. The same convention applies for the direction statements used herein.

The term "closed configuration" refers to an ejection port cover configuration in which the ejection port cover immovably covers the ejection port, thereby preventing the entry of dirt into the interior of the rifle.

The term "open configuration" refers to an ejection port cover configuration in which the ejection port cover leaves the ejection port substantially uncovered, so that shells can be ejected through the ejection port.

the term "about" refers hereinafter to a range of plus or minus 10% around a value.

In use, the slideable ejection port cover is mounted on a firearm such as a rifle, typically in a conventional manner, such that, in the open configuration, the ejection port cover leaves the ejection port substantially uncovered so that shells can exit through the ejection port.

In a conventional firearm with ejection port, at one end of the cover's travel, the ejection port is completely covered by the ejection port cover and, at the other end of the cover's travel, the ejection port is substantially completely uncovered. Transition between the closed and open configurations is done manually, typically by sliding the shutter forward and backward along the longitudinal axis of a rifle's receiver.

Figure 4A:
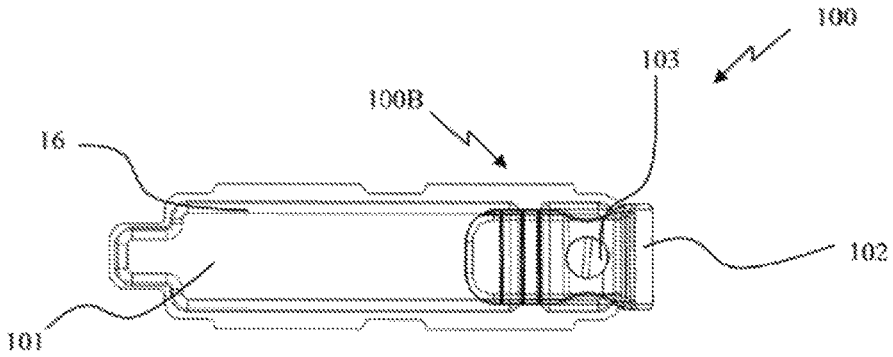
FIGS. 4A-B schematically present an embodiment of the ejection port cover in its opened configuration as disclosed in the present invention, in a front and top view, respectively.
Figure 4B:
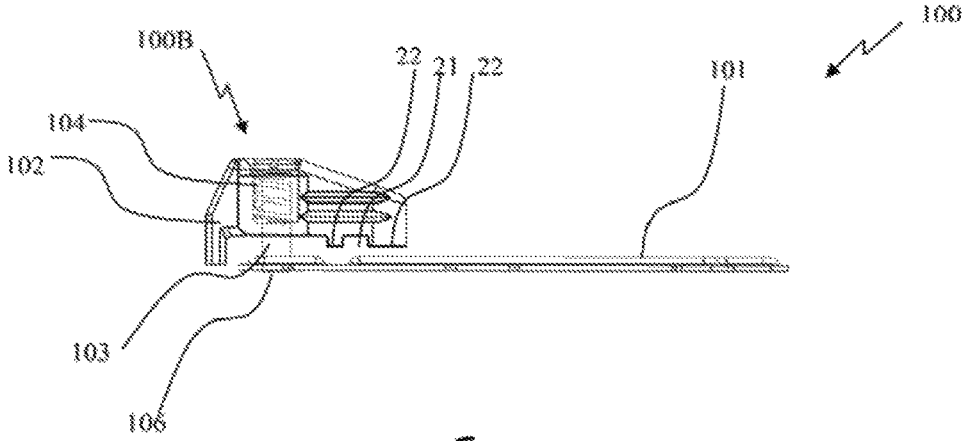
Figure 5:
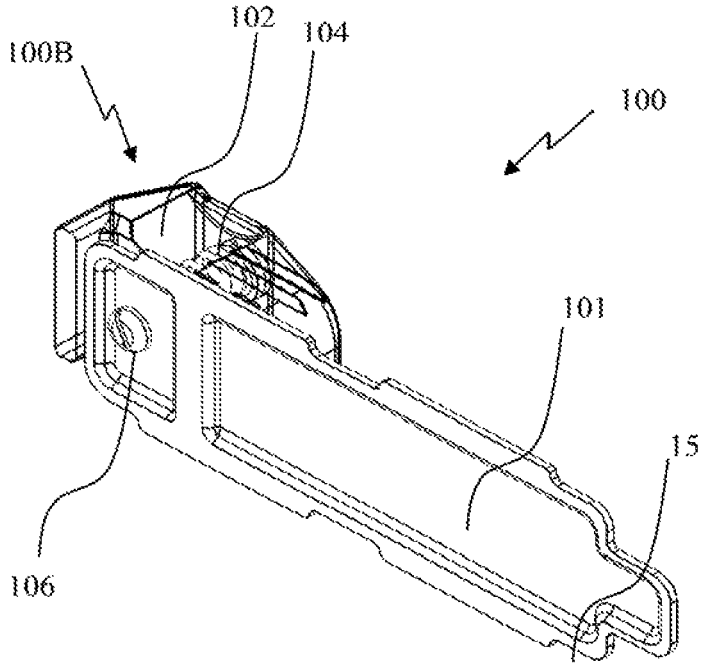
FIG. 5 schematically presents a perspective view of the embodiment of the ejection port cover in its open configuration, as shown in FIGS. 4A-B.
Figure 7B:
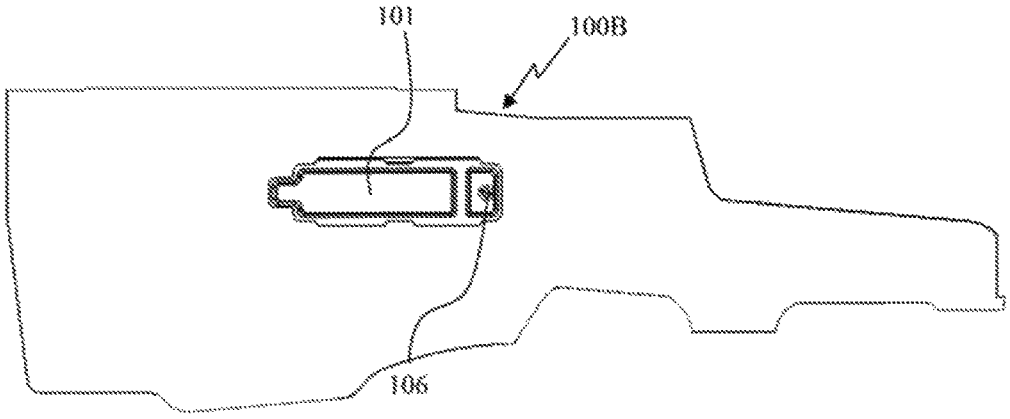
Figure 8:
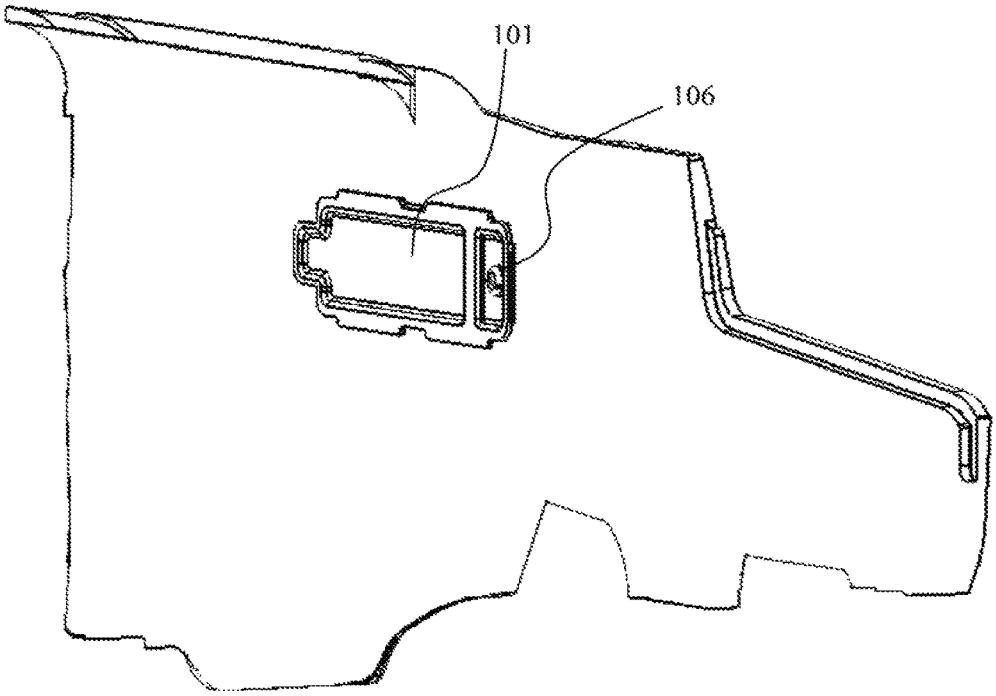
FIG. 8 schematically presents a perspective view of the insides of the rifle's receiver as shown in FIGS. 7A-B.
Figure 9A:
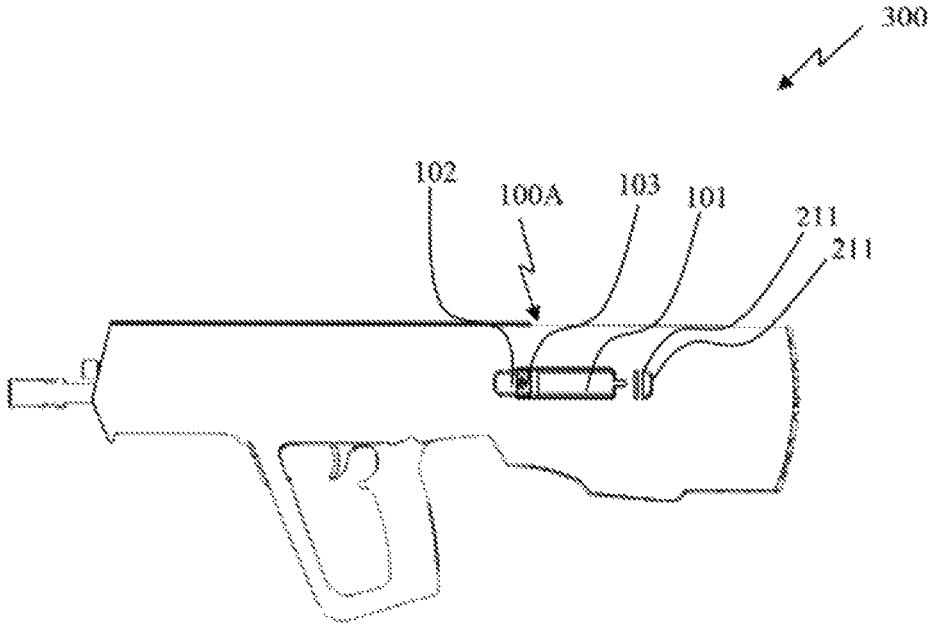
FIGS. 9A-B schematically present the left side of a rifle in a closed configuration and the right side of a rifle in an open configuration, respectively, both configurations comprising the receiver adapted to encompass the port cover of the present invention.
Figure 9B:
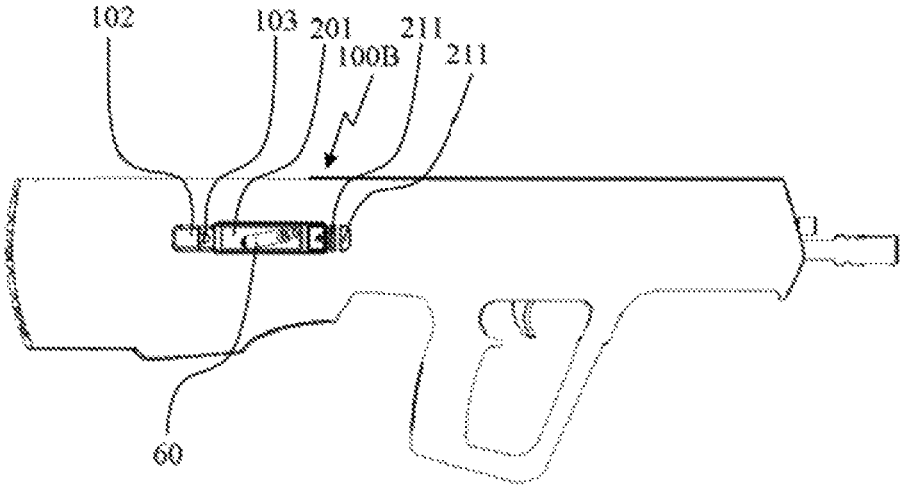

The slideable ejection port cover assembly is characterized by two positions: a closed configuration, in which, when the ejection port cover is mounted on a rifle, the ejection port is covered and dirt is prevented from entering the body of the rifle, as demonstrated in FIGS. 1, 2, 3, 6B, 7B, 8 and 10, and an open configuration, in which, when the ejection port cover is mounted on a rifle, the ejection port is uncovered and shell ejection is enabled, as demonstrated in FIGS. 4, 5, and 9B.

Transition between the closed configuration and the open configuration is made manually, as described hereinbelow, during periods when the ejection port cover is in release mode.

Figure 1A:
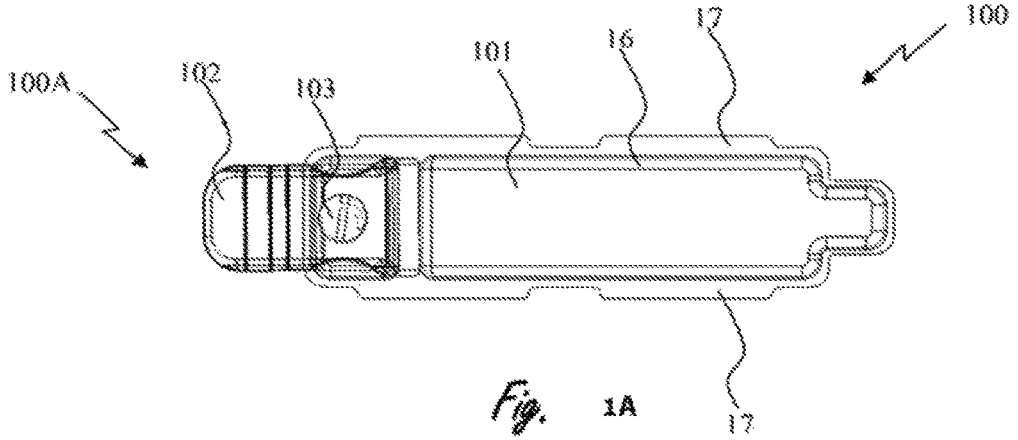
FIGS. 1A-C schematically present an embodiment of the ejection port cover in its closed configuration as disclosed in the present invention, in a front, rear and top view, respectively.
Figure 1B:
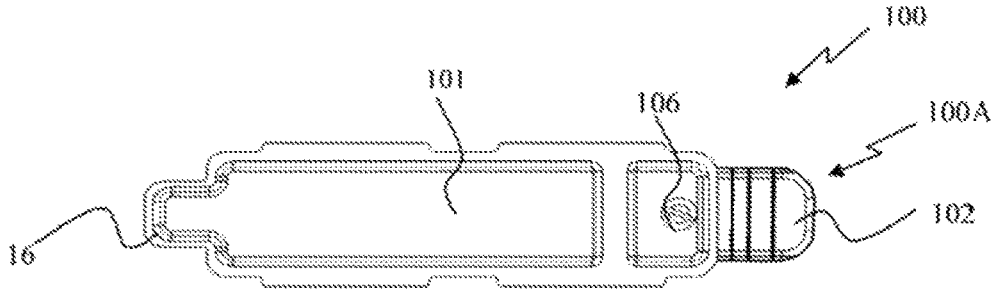
Figure 1C:
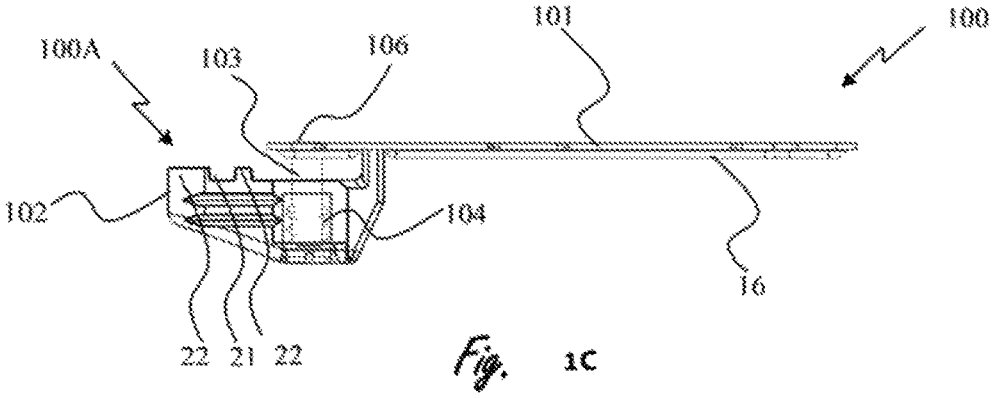

Reference is now made to FIG. 1 showing the slideable ejection port cover (100) in its closed configuration 100A. The ejection port cover is characterized by having a locking component 102 and a shutter 101.

The shutter is adapted to be fitted to the ejection port of a firearm and to reversibly cover and uncover the ejection port.

The locking component 102 is adapted to perform two functions:

When the ejection port cover is in its closed configuration 100A, the locking component 102 prevents movement of the shutter relative to the ejection port, thereby sealing the ejection port.

When the ejection port cover is in its open configuration 100B (see FIGS. 4-5, below), the locking component 102 has two functions. One function is as a spent case deflector, also known as a brass deflector, which prevents spent cartridge cases from striking the face of user or striking persons standing nearby. In addition, in the open configuration, the locking component locks the shutter in a position such that the ejection port is uncovered and shells can exit freely through the ejection port.

The locking component 102 comprises a tension-applying component 104, preferably, but not limited to, a spring, which is adapted to provide two modes: a pressure applying mode and a release mode, with the pressure applying mode being the default mode.

In the release mode, the locking component 102 can rotate about an axis substantially perpendicular to both the main longitudinal axis and the main transverse axis of the shutter 101, thereby enabling reversible transformation of the ejection port cover from the open configuration 100B to the closed configuration 100A. In preferred embodiments, the locking component 102 can rotate about the at least one screw (described below) which provides the mechanical connection between the locking component 102 and the shutter 101.

In the closed configuration 100A, at such times as the ejection port cover is mounted on a firearm (not shown), the ejection port cover is substantially immovable relative to the receiver of the firearm so that entry of dirt through the ejection port is not possible.

In the pressure applying mode of the tension applying component, at such times as the ejection port cover is mounted on a firearm (not shown), pressure is applied between the receiver and the locking component 102. This pressure holds the locking component 102 and the shutter 101 substantially immovable relative to the receiver. In the closed configuration, the shutter 101 substantially immovably covers the ejection port; in the open configuration, the ejection port is open, as the shutter 101 is held substantially immovable in a position which leaves the ejection port substantially uncovered.

In the release mode, at such times as the ejection port cover 100 is mounted on a firearm (not shown), there is little or no pressure between the receiver and the locking component 102 so that the locking component 102 and the shutter 101 can be moved relative to the receiver. In order to transform the ejection port cover into release mode, pulling of the locking component 102 is required. To transform the ejection port cover 100 from closed configuration 100A to open configuration 100B or vice versa, the ejection port cover 100 is put into the release mode by pulling on it. While in the release mode, the shutter 101 is pushed, typically by hand, so that it slides in its groove in the receiver to the opposite end of its travel, thereby uncovering a closed ejection port or, conversely, covering an unclosed ejection port. The locking component 102 is then released, thereby retaining the ejection port cover 100 in its new configuration.

The mechanical connection between the locking component 102 and the shutter 101 is preferably via screws. A preferred embodiment comprises at least two screws, a first screw 103 which is passed through the direction of the locking component 102 and a second screw 106 is passed through from the direction of the shutter 101. The first screw and second screw are typically connected through a conventional male-female locking mechanism, although any conventional means can be used to produce a screw with flanges at both ends. The first and second screws enable the rotation of the locking component 102 with respect to the longitudinal axis of the shutter 101 by an angle of at least about 180° and up to about 360°.

The shutter 101 has at least one flange 17 which typically engages in a conventional manner with grooves in the receiver, such that, with the ejection port cover in an open configuration 100B, the shutter 101 can slide forward and backward relative to the ejection port. In preferred embodiments, the shutter 101 has guides for guiding the sliding movements and for ensuring a good seal between the shutter 101 and the receiver. Such guides are preferably ridges 16, i.e. prominent lines on a side of the shutter 101, although they can be in the form of furrows 15, i.e. grooves in a side of the shutter 101 which ride on a ridge in the receiver. The furrows and/or ridges can be provided along the entire perimeter of the shutter 101 or only a part of it.

Figure 2:
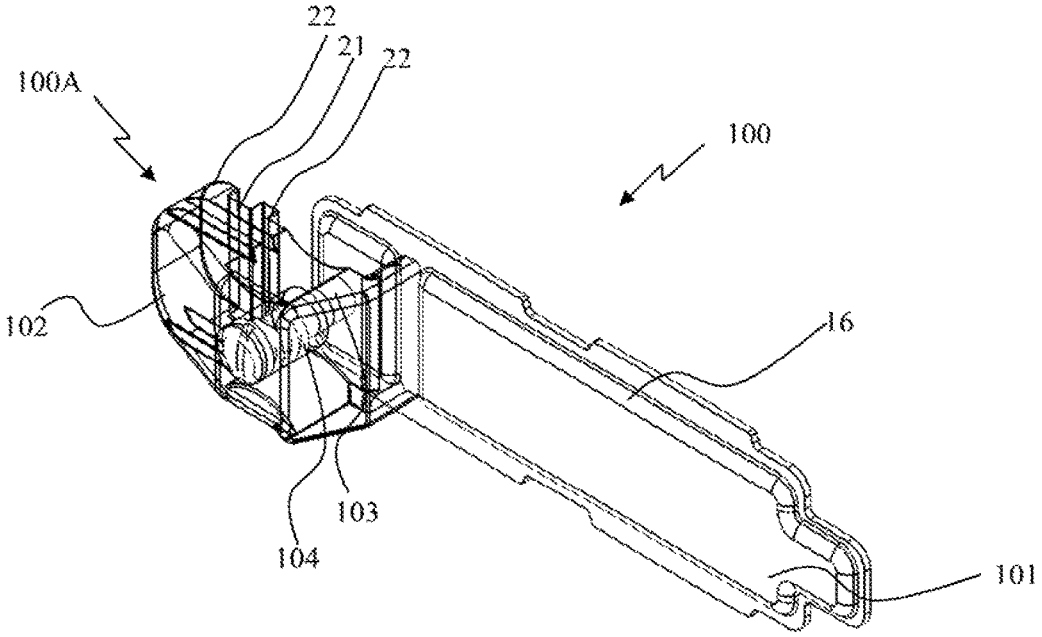
FIG. 2 schematically presents a perspective view of the embodiment of the ejection port cover in its closed configuration, as shown in FIGS. 1A-C.

Reference is now made to FIG. 2 illustrating a perspective view of the ejection port cover as shown in FIG. 1. Shown is the locking component 102, in a mechanical connection with the shutter 101, via at least one screw 103 and applying pressure via pressure component 104, a spring.

The locking component 102 also comprises a first portion of a mechanical connector to prevent, in the locked configuration, movement of the locking component 102 relative to the rifle and, in the open configuration 100B, movement of the locking component 102 relative to the rifle. In preferred embodiments, the rifle comprises a second portion of the mechanical connector, the first portion of the connector and the second portion of the connector mating together to lock the mechanical connector to the rifle.

In the preferred embodiment shown in FIG. 2, the first portion of the mechanical connector comprises a groove 21 and two ribs 22 which are adapted for locking into the second portion of the mechanical connector, comprising coordinated grooves and/or ribs in the rifle.

In other embodiments, any number of grooves 21 and ribs 22 can be used. Preferably, the number of grooves 21 is less than 4 and the number of ribs 22 is less than 4 on both the locking component 102 and the rifle. Minimal embodiments include: one rib and one groove coordinating with one groove and one rib, and (as shown) one groove and two ribs coordinating with one rib (not shown; on the receiver). It should be noted that the side of the mechanical connector with the single rib can be on the receiver or on the locking component.

In the closed configuration 100A with the locking component 102 in its default pressure-applying mode, the locking of the grooves 21 and ribs 22 into the coordinating ribs and/or grooves in the rifle ensures that the ejection port is substantially sealed; sliding movement of the shutter 101 relative to the ejection port is prevented.

In some embodiments, the shutter 101 comprises coordinating ribs and/or grooves, similar to those on the rifle. In such embodiments, in the open configuration 100B with the locking component 102 in its default pressure-applying mode, the grooves 21 and ribs 22 in the locking component 102 and shutter 101 fit into each other, in a manner similar to the fit between the grooves and ribs of locking component 102 and the rifle, thereby locking the locking component 102 more securely into position.

In the open configuration 100B (see FIG. 4, below), with the locking component 102 in its default pressure-applying mode, the pressure between the shutter 101 and grooves 21 and ribs 22 and between the shutter 101 and the receiver holds the locking component and the shutter 101 substantially immovable relative to the rifle. The direction pattern of ejection of cartridge cases from the interior of the rifle is known. Therefore, during the ejection process, the cartridge cases will hit the locking component 102 with a known direction pattern and will therefore, since the locking component 102 is held in a substantially fixed position relative to the ejection port, be deflected into a known deflection pattern, with the deflection pattern defined by the shape of the locking component 102.

Figure 3:
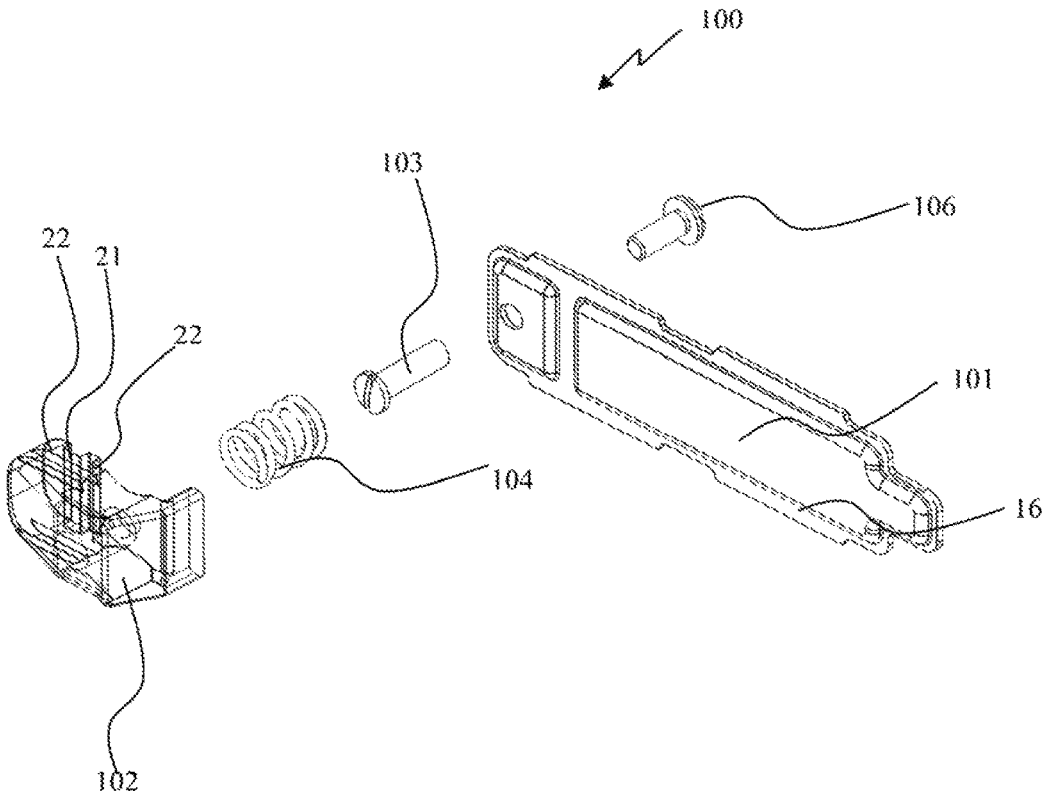
FIG. 3 schematically presents an exploded view of the ejection port cover as shown in FIGS. 1A-C and 2.

Reference is now made to FIG. 3 illustrating an exploded view of the ejection port cover assembly shown in FIGS. 1-2. The locking component 102 is found in a mechanical connection to the surface contour 101, preferably via two screws 103, 106, which are preferably connected through a male-female locking mechanism. The tension applying component, in this embodiment, a spring, is preferably wrapped around the first screw 103, and is adapted to maintain the locking component 102 in compression, applying pressure in the direction of the surface contour.

Reference is now made to FIG. 4, illustrating front (FIG. 4A) and top (FIG. 4B) views of the ejection port cover in an open configuration 100B, whereby a shell ejection through the ejection port is enabled. To transform the ejection port cover from the closed configuration 100A shown in FIGS. 1-3 to the open configuration 100B shown in FIGS. 4 and 5, the locking component 102 is moved so that it rests substantially over the shutter 101, preferably by rotating the locking component 102 about the screw 103-106. Since, in the open configuration 100B, the locking component 102 is no longer held against the receiver, opening of the ejection cover in the rifle by sliding the port cover towards the front of the rifle is enabled. The locking component 102 is still held in compression by the at least one screw 103-106 passing through the locking component 102 and through the shutter 101, and the tension applying mechanism 104, which is coiled around the screws. Grooves 21 and ribs 22 may be provided; in some embodiments, in the open configuration 100B they can lock the locking component 102 over corresponding grooves and/or ribs in the receiver.

Reference is now made to FIG. 5, illustrating a perspective view of the ejection port cover 100 shown in FIG. 4. The view illustrates the securing screw 103-106 passing from the direction of the shutter 101 and into the locking component 102.

Figure 6A:
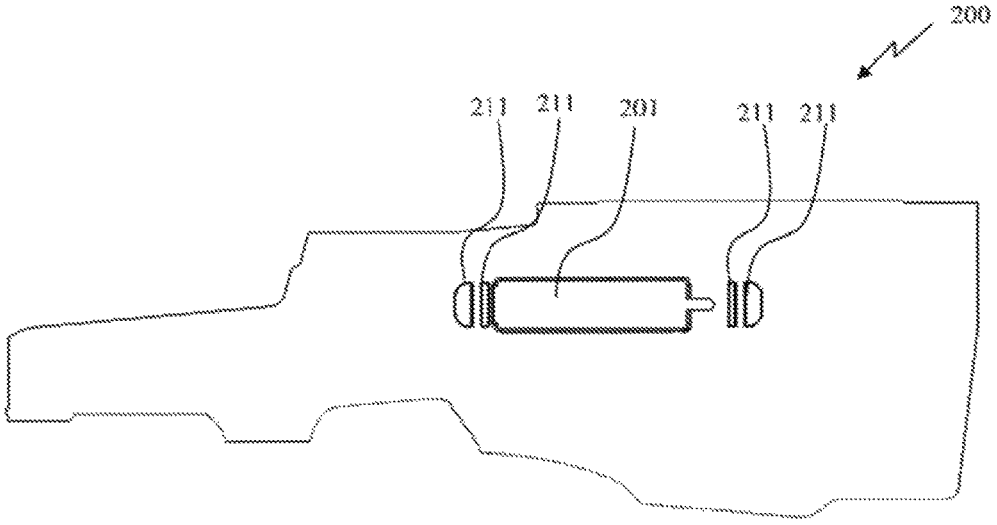
FIGS. 6A-B schematically present the outside view of a rifle's receiver adapted to encompass the ejection port cover of the present invention, without and with the port cover, respectively.
Figure 6B:
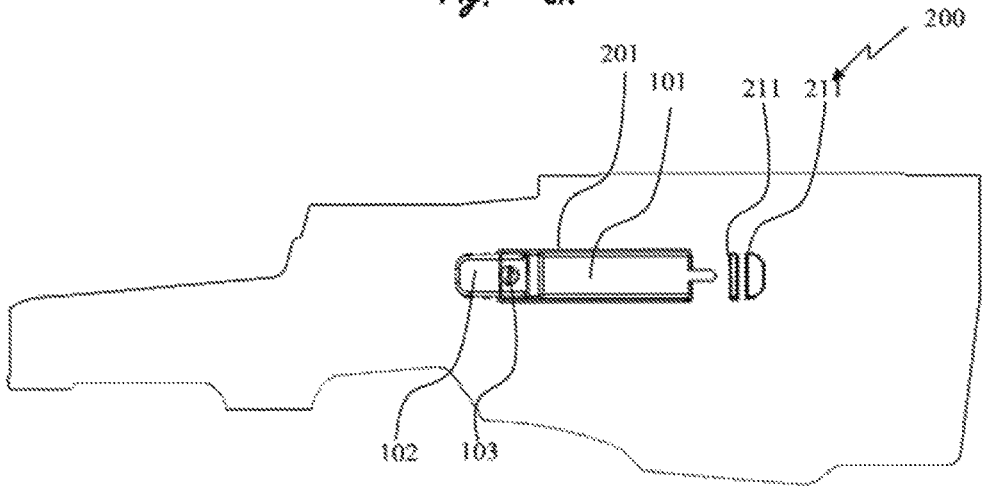

Reference is now made to FIG. 6, illustrating, from the outside, a rifle's receiver 200, adapted for containing the ejection port cover 100 disclosed by the present invention. FIG. 6A illustrates an outside view of the receiver 200, demonstrating the ejection port 201 and grooves 211, adapted to coordinate with the grooves 21 and ribs 22 previously shown in the locking component 102 of the ejection port cover 100. FIG. 6B demonstrates the rifle's receiver while comprising the ejection port cover 100, illustrating the shutter 101 covering the ejection port 201, and the locking component 102 rotated away from the shutter 101 to enable its locking into place by the corresponding grooves and/or ribs 211 on the receiver.

Figure 7A:
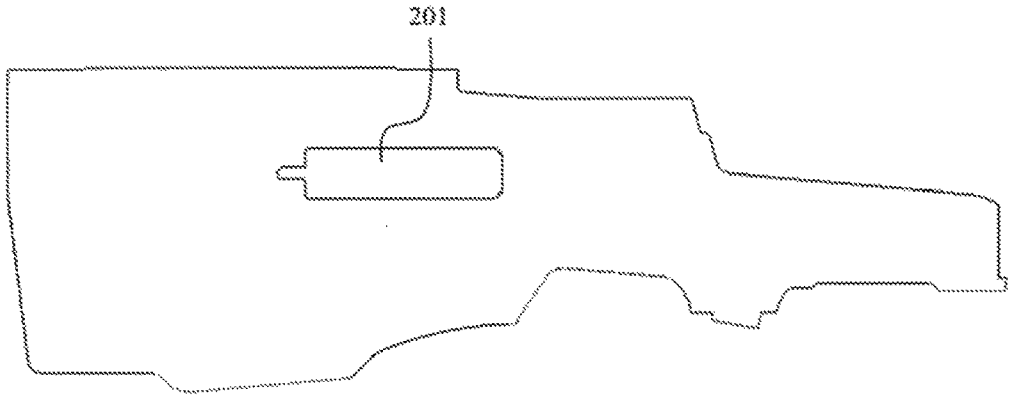
FIGS. 7A-B schematically present the insides views of the rifle's receiver as shown in FIGS. 6A-B, adapted for containing the ejection port cover, and with the ejection port cover in a closed configuration, respectively.

Reference is now made to FIG. 7, illustrating a view the rifle's receiver of FIG. 6 from the inside. FIG. 7A depicts the receiver adapted for containing the ejection port cover 100, and FIG. 7B depicts the receiver with the ejection port cover in a closed configuration 100A. The furrow 15 and/or ridge 16 assist in guiding the sliding movement of the port cover relative to the receiver 200 during opening or closing of the shutter 101, which, in preferred configurations, is done manually. The flange 17 (not shown) on the shutter 101 slides in a groove (not shown) in the receiver.

Reference is now made to FIG. 8, illustrating the rifle receiver of FIG. 6 in a perspective inside view.

Reference is now made to FIG. 9, demonstrating a use of the ejection port cover in a rifle, where the left side of the rifle is in a closed configuration 100A (FIG. 9A) and the right side of the rifle is in an open configuration 100B (FIG. 9B). In a closed configuration 100A the locking component 102 is rotated away from the shutter 101 as in FIG. 9A, and in an open configuration 100B, the locking component 102 is rotated towards the shutter 101. In the position of the open configuration 100B, ejected shell 60 can be ejected through the opened ejection port 201 and the shutter 101 in its closed configuration 100A prevents dirt from entering the interior of the receiver through the opposing, closed, ejection port.

Figure 10:
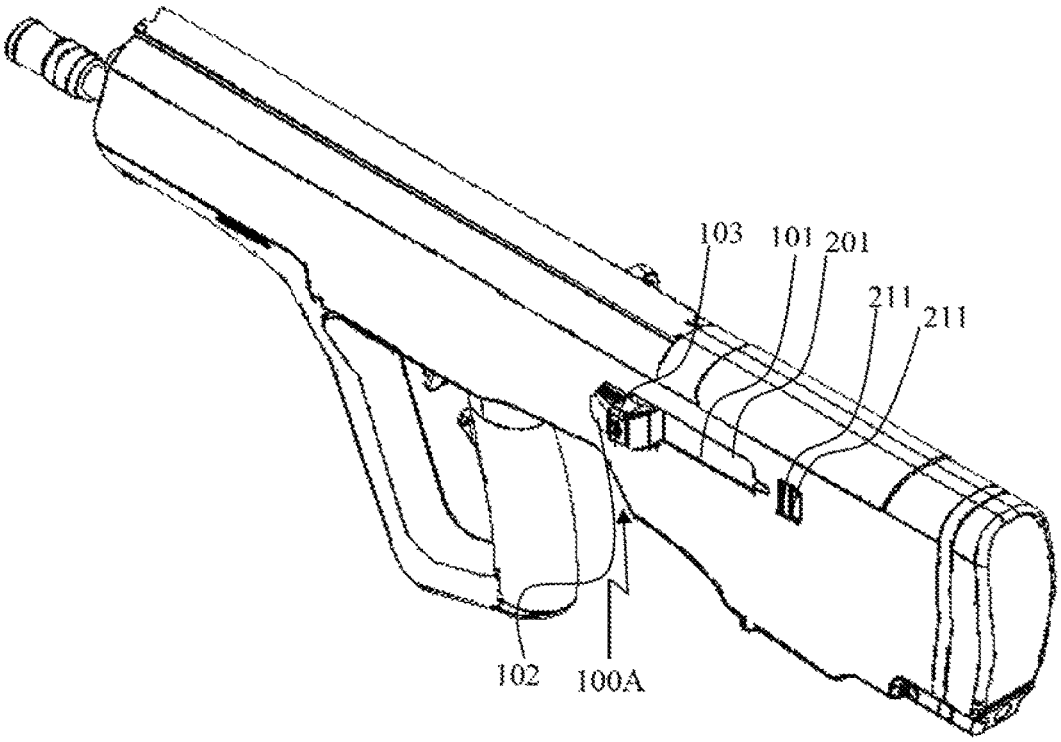
FIG. 10 schematically presents a perspective view of the rifle shown in FIGS. 9A-B, having an ejection port cover in a closed configuration.

Reference is now made to FIG. 10, illustrating a perspective view of the rifle of FIG. 9A.

While the invention is susceptible to various modifications and alternative forms, specific embodiments thereof have been shown by way of example in the drawings and the above detailed description. It should be understood, however, that it is not intended to limit the invention to the particular forms disclosed, but on the contrary, the intention is to cover all modifications, equivalents, and alternatives falling within the spirit and scope of the invention as defined by the appended claims.

The invention claimed is:

1. A slideable ejection port cover (100) for right-side or left-side shell ejection, for use in a rifle's receiver (200), said receiver (200) characterized by:

an ejection port (201);

said slideable ejection port cover (100) characterized by having at least two configurations:

(i) an open configuration (100B) in which, at such times as said slideable ejection port cover (100) is in use in said receiver (200), and (ii) a closed configuration (100A) in which, at such times as said slideable ejection port cover (100) is in use in said receiver (200), said ejection port (201) is substantially immovably covered; said ejection port cover (100) comprising a shutter (101) operatively connected to a locking component (102), said shutter (101) slideable along a longitudinal axis of said receiver (200);

wherein said locking component (102) comprises a spring (104) configured, at such times as said slideable ejection port cover (100) is used in said rifle's receiver (200) and said ejection port cover (100) is in said closed configuration (100A), to hold said locking component (102) in a pressure-applying mode against said receiver, said pressure-applying mode being a default mode, thereby immobilizing said shutter (101) relative to said receiver (200), and said locking component (102) configured to compress said spring (104) when pulled manually away from said receiver, thereby enabling reversible transformation of said ejection port cover (100) from said closed configuration (100A) to said open configuration (100B);

wherein said shutter (101) is configured to slide backward relative to the ejection port to uncover said ejection port and to enable shell ejection via said ejection port, resulting in said open configuration (100B), and wherein said shutter (101) is configured to slide forward relative to the ejection port to cover said ejection port, resulting in said closed configuration (100A).

2. The ejection port cover (100) according to claim 1, wherein said ejection port cover (100) additionally comprises at least one securing screw (103, 106) configured to enable rotation of said locking component (102) with respect to said port cover (100) in an angle between about 180° and about 360°.

3. The ejection port cover (100) according to claim 2, wherein said ejection port cover (100) additionally comprises at least two securing screws (103, 106), at least one first securing screw and at least one second securing screw configured to be in a mechanical connection of a male-female locking mechanism.

4. The ejection port cover (100) according to claim 1, wherein, in said open configuration (100B), said locking component (102) is substantially immovable relative to said receiver.

5. The ejection port cover (100) according to claim 1, wherein, in said open configuration (100B), said default pressure-applying mode of said spring (104) is configured to hold said locking component (102) against said receiver, thereby substantially immobilizing said locking component (102) and said shutter (101) relative to said receiver.

6. The ejection port cover (100) according to claim 1, wherein, in said open configuration (100B), at such times as said slideable ejection port cover (100) is in use in said receiver (200), said locking component (102) is adapted to function as a spent case deflector.

7. The ejection port cover (100) according to claim 1, wherein said locking component (102) comprises at least a first portion of a mechanical connector, said at least first portion of said mechanical connector characterized by a member of a group consisting of: a groove (21), a rib (22) and any combination thereof on said locking component (102), for reversibly locking said locking component (102) in place.

8. The ejection port cover (100) according to claim 7, wherein said receiver (200) comprises at least a second portion of said mechanical connector, said at least second portion of said mechanical connector characterized by a member of a group consisting of: a groove (21), a rib (22) and any combination thereof on said receiver (200), said at least second portion of said mechanical connector configured to coordinate with said at least first portion of said mechanical connector.

9. The ejection port cover (100) according to claim 7, wherein said shutter (102) further comprises at least a third portion of said mechanical connector, said at least third portion of said mechanical connector characterized by a member of a group consisting of: a groove (21), a rib (22) and any combination thereof on said shutter (101), said at least third portion of said mechanical connector configured to coordinate with said at least first portion of said mechanical connector.

10. The ejection port cover (100) according to claim 1, wherein said shutter (101) further comprises at least one of a group consisting of a furrow (15), a ridge (16) and any combination thereof adapted for guiding said shutter (101) along a longitudinal axis of said receiver (200).

11. The ejection port cover (100) according to claim 10, wherein said at least one of a group consisting of a furrow (15), a ridge (16) and any combination thereof is located along at least part of a contour of said shutter (101).

12. The ejection port cover (100) according to claim 11, wherein at least one said ridge (16) coordinates with at least one said furrow (15), said ridge (16) located on an opposite side of said shutter (101) from said furrow (15).

13. The ejection port cover (100) according to claim 1, wherein said ejection port cover (100) further comprises a flange (17) adapted to slide in a groove in said receiver (200), said ejection port (101) reversibly coverable by means of said sliding movement.

14. The ejection port cover (100) according to claim 1, wherein said manual pulling of said locking component (102) disengages said locking component (102) from said receiver (200), enabling transformation of said ejection port cover (100) from said closed configuration (100A) to said open configuration (100B).

15. The ejection port cover (100) according to claim 1, wherein said manual pulling of said locking component disengages said locking component from said receiver, enabling transformation of said ejection port cover from said open configuration (100B) to said closed configuration (100A).

16. The ejection port cover (100) according to claim 1, wherein rotation of said locking component about an axis substantially perpendicular to said shutter (101) by about 180° reversibly transforms said ejection port cover from said closed configuration (100A) to said open configuration (100B).

17. In a rifle's receiver (200), a slideable ejection port cover (100) for right-side or left-side shell ejection; characterized by having at least two configurations;

(i) an open configuration (100B); and (ii) a closed configuration (100A) in which said ejection port is substantially immovably covered;

said ejection port cover (100) comprising a shutter (101) operatively connected to a locking component (102), said shutter (101) slideable along a longitudinal axis of said receiver (200), wherein said locking component (102) comprises a spring (104), configured to hold said locking component (102) in a default pressure-applying mode against said receiver (200), thereby immobilizing said shutter (101) relative to said receiver (200), and said locking component (102) configured to compress said spring (104) when pulled manually away from said receiver (200), thereby enabling reversible transformation of said ejection port cover (100) from said closed configuration (100A) to said open configuration (100B);

wherein said shutter (101) is configured to slide backward relative to the ejection port to uncover said ejection port and to enable shell ejection via said ejection port, resulting in said open configuration (100B), and wherein said shutter (101) is configured to slide forward relative to the ejection port to cover said ejection port, resulting in said closed configuration (100A).

18. The rifle receiver (200) of claim 17, wherein said receiver (200) comprises at least two ejection ports (201) positioned on opposite sides thereof, each of which is adapted to accommodate said ejection port cover (100).

19. A method for either right-side or left-side shell ejection, comprising steps of:

a. obtaining a slideable ejection port cover (100) for use in a rifle's receiver (200), said receiver characterized by an ejection port (201); said slideable ejection port cover (100) characterized by having at least two configurations;

(i) an open configuration (100B) in which, at such times as said slideable ejection port cover (100) is in use in said receiver (200), shell ejection via said ejection port (201) is enabled; and (ii) a closed configuration (100A) in which, at such times as said slideable ejection port cover (100) is in use in said receiver (200), said ejection port (201) is substantially immovably covered; said ejection port cover (100) comprising a shutter (101) operatively connected to a locking component (102), said shutter (101) slideable along a longitudinal axis of said receiver (200);

b. mounting said ejection port cover (100) to said rifle's receiver (200); and c. reversibly sliding said shutter (101) along a longitudinal axis of said receiver;

wherein said method further comprises steps of:

(a) configuring a spring (104) to hold said locking component (102), at such times as said ejection port cover (101) is in said closed configuration (100A), in a default pressure-applying mode against said receiver, thereby immobilizing said shutter (101) relative to said receiver (200), and (b) configuring said locking component (102) such that manually pulling said locking component (102) away from said receiver (200) compresses said spring (104), thereby enabling reversible transformation of said ejection port cover (100) from said closed configuration (100A) to said open configuration (100B);

wherein said shutter (101) is configured to slide backward relative to the ejection port (201) to uncover said ejection port (201) and to enable shell ejection via said ejection port, resulting in said open configuration (100B), and wherein said shutter (101) is configured to slide forward relative to the ejection port (201) to cover said ejection port (201), resulting in said closed configuration (100A).

20. The method according to claim 19, further comprising step of adapting said locking component (102) to function as a spent case deflector at such times as said slideable ejection port cover (100) is in use in said receiver (200) and said slideable ejection port cover (100) is in said open configuration (100B).

* * * * *